US005755557A

United States Patent [19]

Alizadeh

[11] Patent Number: 5,755,557

[45] Date of Patent: May 26, 1998

[54] AXIAL FLOW FAN

[75] Inventor: Ahmad Alizadeh, Indianapolis, Ind.

[73] Assignee: Valeo Thermique Moteur, Le Mesnil-Saint Denis, France

[21] Appl. No.: 510,821

[22] Filed: Aug. 3, 1995

[51] Int. Cl.[6] ..... F04D 29/38

[52] U.S. Cl. ..... 416/193 R; 416/169 A; 416/203; 416/238

[58] Field of Search ..... 416/169 A, 175, 416/223 R, 189, 192, 193 R, 203, 238; 415/77, 78, 79, 119

[56] References Cited

U.S. PATENT DOCUMENTS

| | | | |
|---|---|---|---|
| 1,232,795 | 7/1917 | Hagen | 416/193 R |
| 1,986,151 | 1/1935 | Johnston | 416/193 R |
| 5,221,187 | 6/1993 | Lorea et al. | 416/189 |
| 5,244,347 | 9/1993 | Gallivan et al. | 416/189 |
| 5,273,400 | 12/1993 | Amr | 416/169 A |
| 5,454,695 | 10/1995 | Shah et al. | 416/203 |

*Primary Examiner*—Edward K. Look
*Assistant Examiner*—Christopher Verdier
*Attorney, Agent, or Firm*—Morgan & Finnegan, LLP

[57] ABSTRACT

An axially compact axial flow fan with improved air-moving properties has a first array of fan blades that extend radially from a fan hub to a circumferential blade support member, a second array of fan blades extend from the first support member to a radially outward second circumferential blade support member. The fan blades in the second array each enjoy pitch angles that decrease from the second circumferential blade support radially along only a portion of each blade length. Thereafter, the pitch angles for the blades in the second array remains constant to the second circumferentially extending blade support member.

22 Claims, 13 Drawing Sheets

AXIAL FLOW FAN

FIELD OF THE INVENTION

The present invention relates to an axial flow fan, and more specifically but not exclusively to such a fan suitable for use in a vehicle cooling system.

BACKGROUND TO THE INVENTION

Axial flow fans are well known, and generally consist of plural blades disposed regularly about and supported by a central hub member at the blade root portions. The blade tip portions may be attached to and supported by a blade tip support ring. Axial flow fans are commonly moulded from plastics material.

It may be desirable to provide an axial flow fan having a reduced axial extent. This requirement occurs, for example, in a cooling arrangement in which the fan is disposed between two heat exchangers so as to draw air through one and blow air through the other. Fans of reduced axial extent are, of course, desirable in other circumstances.

A difficulty which arises as the axial extent of a fan is reduced, is that the axial length of the hub member reduces, thus providing less space for attachment thereto of the blade root portions. It is desirable to pitch the blades at an angle to a plane perpendicular to the axis of rotation for enhancing the fan performance and thus, as the axial fan extent decreases, the chord length of blades is reduced. This has the consequence that the so-called "solidity ratio", i.e. the ratio between the chord length and the overall blade spacing, becomes small, leading to reduced ability to move air. To some extent this may be ameliorated by reducing the diameter of the hub member, thus providing longer blades for a given diameter of fan. However this reduces the circumferential extent of the hub member which means that numerically fewer blades of a given chord length may be secured thereto.

Accordingly it is an aim of the present invention to provide an axial flow fan which may have reduced axial extent while retaining good air-moving properties, or providing improved air-moving properties.

To achieve these aims it is desirable to provide a fan having a relatively large number of blades in the zone near to the fan periphery, as this is the zone where the maximum air movement is normally provided. At the same time, it is desirable to provide a fan having air moving ability over a large proportion of the fan radial extent, as the greater the proportion of the fan which moves air, the smaller axial extent is need for a given performance.

BRIEF DISCUSSION OF THE INVENTION

According to a first aspect of the present invention there is provided an axial flow fan comprising a hub portion having secured thereto a first plurality of first blades extending therefrom radially outwardly to a first circumferentially-extending blade support member, and a second plurality of second blades extending radially outwardly from the first support member.

According to a second aspect of the present invention there is provided an axial flow fan comprising a hub portion having secured thereto a first plurality of first blades extending therefrom radially outwardly to a first circumferentially-extending blade support member, and a second plurality of second blades extending radially outwardly from the first support member wherein the second plurality of second blades extend to a second circumferentially-extending blade support member.

Advantageously the first plurality is different in number to the second plurality.

Preferably the second plurality is a prime number.

Advantageously the first plurality is a prime number.

Preferably at the first blade support member, at most one of the first blades coincides circumferentially with a second blade.

Advantageously the pitch angle of each first blade decreases along the radial extent thereof.

Conveniently the pitch angle of each second blade decreases along the radial extent thereof.

Preferably the chord length of each first blade increases along the radial extent thereof.

Advantageously the chord length of each second blade remains substantially constant along the radial extent thereof.

Conveniently the axial extent of the hub member is greater than the axial extent of the first blade support member.

Advantageously the second blade tip support member has a smaller axial extent than the first blade support member.

In one embodiment the first plurality of blades and the second plurality of blades are substantially parallel to respective radii of the fan.

In an alternative embodiment blades of the first plurality are skewed with respect to the direction of rotation of the fan in the same sense as blades of the second plurality.

In yet another embodiment blades of the first plurality are skewed with respect to the direction of rotation of the fan in the opposite sense to blades of the second plurality.

Conveniently, a third plurality of blades extends radially outwardly from the second blade support member.

BRIEF DESCRIPTION OF THE DRAWINGS

Embodiments of the present invention will now be described by way of example with reference to the accompanying drawings in which:

FIGS. 6(A)–(L) show the variation in chord length and chord angle along blades of the fan of the present embodiment, along the lines AA'–LL' of FIG. 5.

In the figures like reference numerals indicate like parts.

DESCRIPTION OF THE PREFERRED EMBODIMENTS

Figure 1:
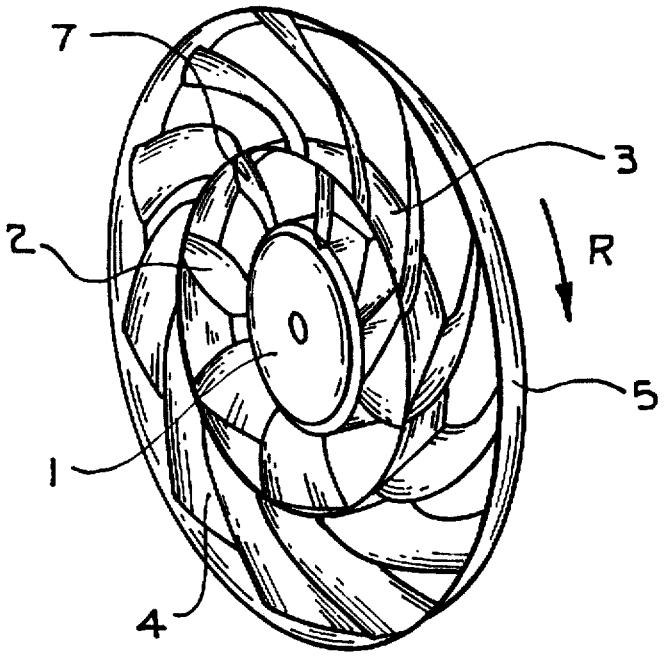
FIG. 1 shows a perspective view of a first embodiment of the fan of the invention.

Referring firstly to FIG. 1, an axial flow fan has a hub member (1) having an external periphery which supports a first plurality of radially-extending first blades (2). At the tip region of the first blades, the first blades are connected together by a first circumferentially-extending blade support member (3), which also forms the root-support member for a second plurality of second blades (4). If desired, the first blades may extend beyond the first support member. The second blades (4) are, in turn, supported at their tip regions by a second blade-tip support member (5) which is disposed concentrically with the fan axis and the first blade tip support member (3).

Figure 2:
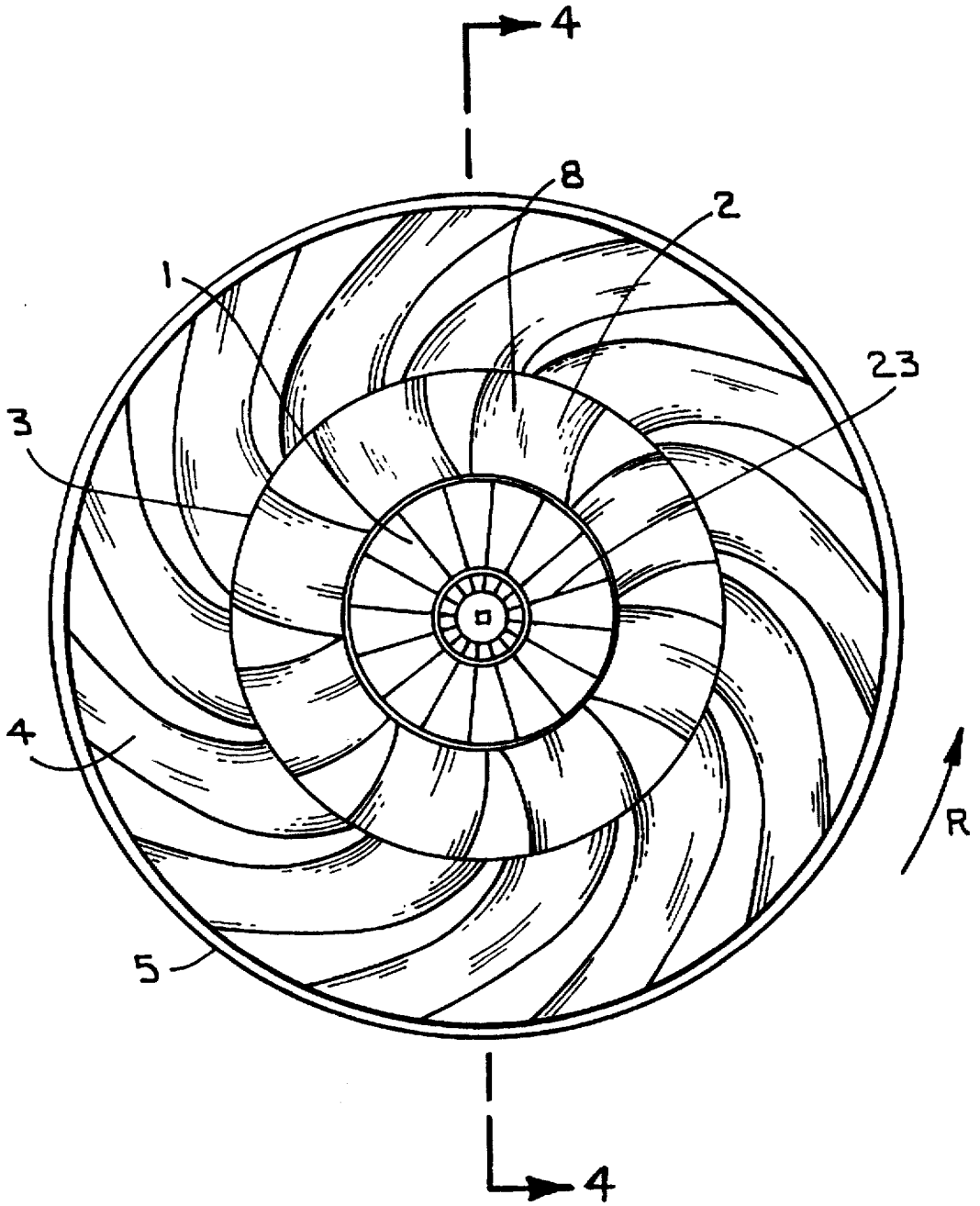
FIG. 2 shows a projection of the fan similar to FIG. 1 onto a plane perpendicular to the axis of rotation of the fan.
Figure 3:
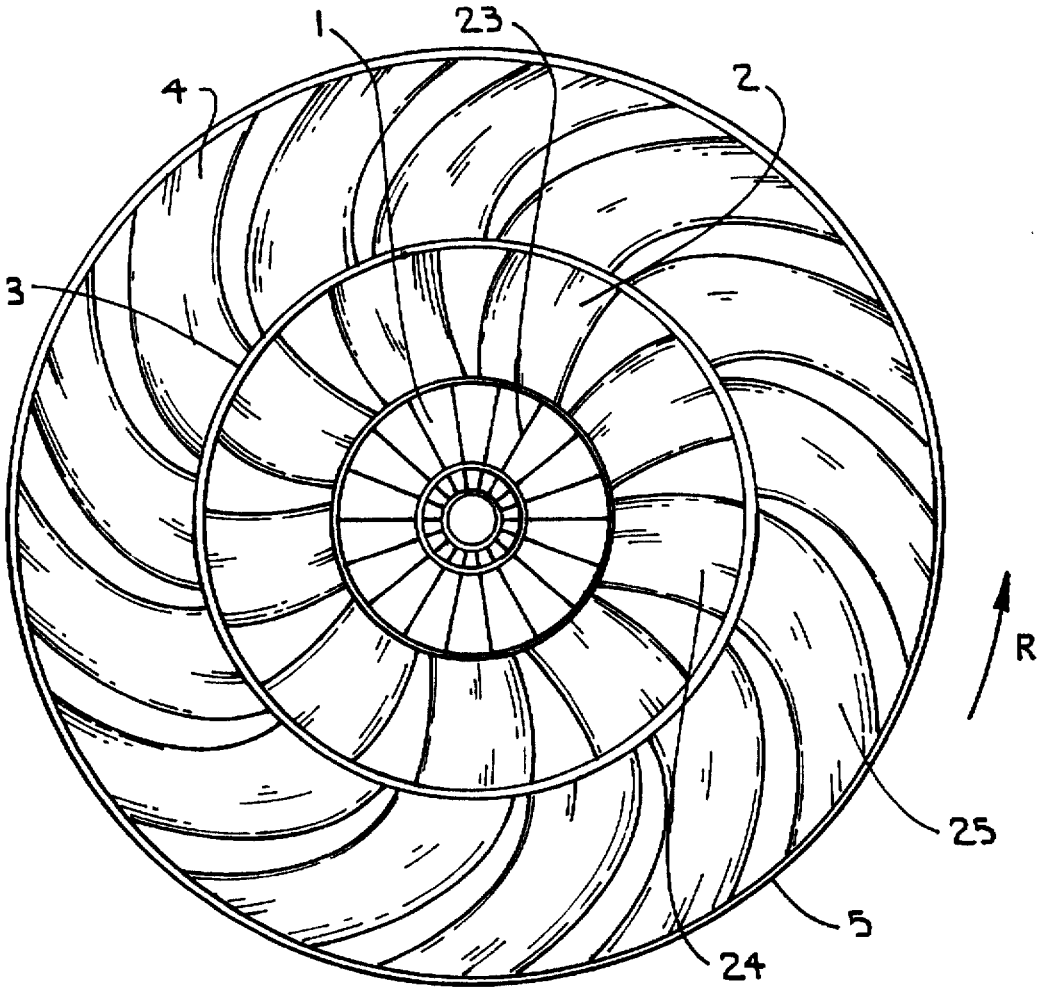
FIG. 3 shows a projection of a second embodiment of a fan, similar to FIG. 2.

FIGS. 2 and 3 show two embodiments of the fan of the invention, having respectively an even number of first blades and a prime number of second blades.

Figure 4:
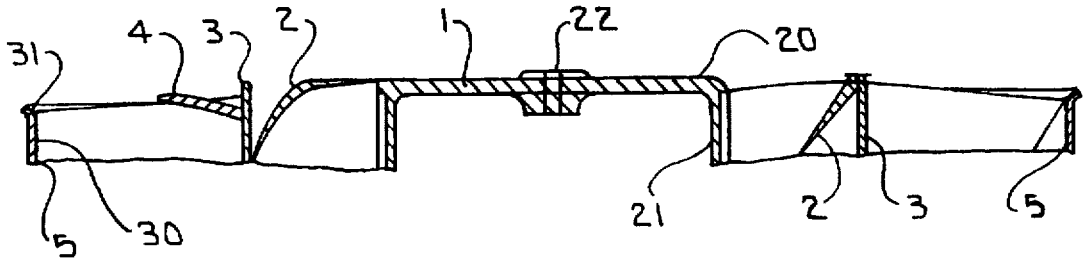
FIG. 4 shows a section through the fan of the present embodiment taken along lines III–III' of FIG. 2.

Turning to FIGS. 3 and 4, the hub member (1) has a generally planar front face portion (20) and a substantially cylindrical side wall portion (21). At the axis of the fan there is provided a hole (22) for a fan drive shaft and the hub member of the embodiment has a hub insert (not shown) moulded into a thickened central region of the hub member, for attachment to and location on the shaft. The hub insert may be of metal or plastics material and may have one or more axial-extending flats which engage with a correspondingly configured shaft.

The fan itself may be formed from metal, but is preferably a single piece injection molded fan of plastics material.

As best shown in FIGS. 2 and 3, the hub member has plural reinforcing ribs (23), which in the embodiments shown extend radially of the hub, and are provided at the rate of two ribs per first blade (2). These ribs provide enhanced stiffness of the hub. Two or more of the ribs may have an increased axial extent so as to move the air within the hub, for example for providing air flow through an electric drive motor having a portion extending within the periphery of the hub portion (1). The ribs (23), or the vane members formed by the above-mentioned extended ribs may be disposed other than radially. For further enhanced air flow within the hub, vane members may be curved along their outward extent in the direction of fan rotation.

The first blades extend from the outer peripheral wall (21) of the hub portion. The first circumferentially-extending blade support member (3) is a substantially cylindrical member concentric with the fan axis and having an axial extent less than that of the peripheral wall portion (21) of the hub member (1). In the embodiment shown, the first blade support member (3) has a front edge which is substantially axially aligned with the front face portion (20) of the hub member (1) and a rear edge which is axially within the axial length of the peripheral wall portion (21).

It is not desirable that the tip regions of the first blades (2) coincide with the root regions of the second blades (4). Coincidence between the first and second blades degrades the acoustic performance of the fan by allowing for resonance effects to occur along the blades. It is however acceptable to allow coincidence, or substantial coincidence, between one first blade and one second blade. In the fan shown in FIG. 2 one first blade (24) substantially coincides with one second blade (25).

In both embodiments there are provided eleven second blades (4) each having their root region secured to the cylindrical first blade support member (3), and having their tips secured to second support member (5). It is desirable, for acoustic reasons, to provide both a prime number of first blades (2) and a prime number of second blades (4), the prime numbers being mutually different. However, as the majority of the air movement takes place due to the second blades (4), the second blades have the greatest tendency to acoustically vibrate. Accordingly, the provision of a prime number of second blades (4) is more necessary to provide good acoustic properties, whereas the relatively low air movement due to the first blades (2) does not make the provision of a prime number of blades so important. The first embodiment, shown in FIG. 1 has seven first blades 2, a prime number of blades, while embodiment in FIG. 2, has eight first blades (2) and the second embodiment shown in FIG. 3, has nine first blades (2).

The first blades (2), as well as providing air movement also have the function of supporting the first blade support member (3), and thus the root portions of the second blades (4). Thus the first blades provide stiffness in the relationship between the hub member and the first blade support member (3).

The fan of the invention has a set of first blades secured to a hub portion which may be of reduced axial and radial extent, and extending to a first blade support ring. The ring has a circumferential extent which is large with respect to the hub portion, and which therefore permits a larger number of second blades to be attached thereto.

By comparison with a fan having a single set of blades secured to a hub member of diameter corresponding to that of the first blade support ring, the fan of the invention has additional air moving power provided by the first blades. By comparison with a fan having a single set of blades secured to a hub member corresponding to that of the fan of the embodiment, a larger number of blades may be provided in the fan of the invention. Thus the plural stage fan of the invention allows increased air moving performance, or allows the production of a fan of reduced axial extent which retains the performance of a fan of normal axial extent.

Returning to FIG. 4, the second blade support member (5) has a first axially-extending cylindrical portion (30) which is disposed concentrically with the fan axis and a second bellmouth portion (31) extending from the cylindrical portion of axially forwardly and radially outwardly. The second blade support member (5) may however have other configurations, depending on the shape of a shroud structure (not shown) associated with the fan for guiding the air flow.

Figure 5:
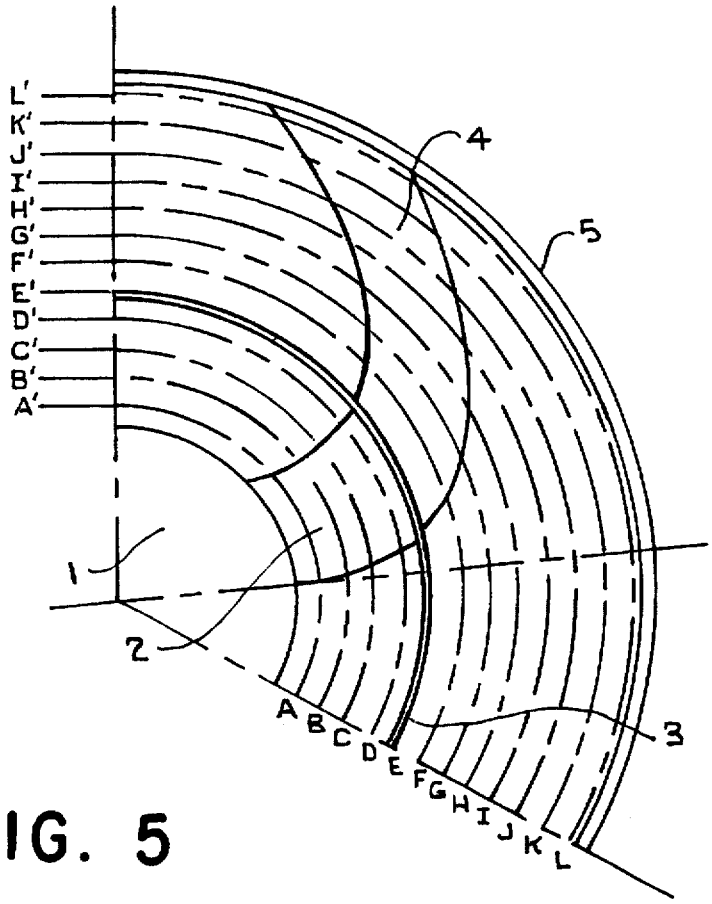
FIG. 5 shows a first inner and a second outer blade with cross-sectional lines.
Figure 6C:
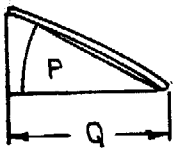
Figure 6B:
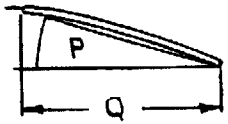
Figure 6A:
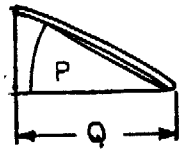
Figure 6F:
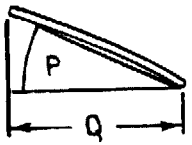
Figure 6E:
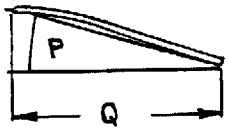
Figure 6B:
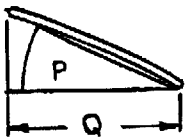
Figure 6I:
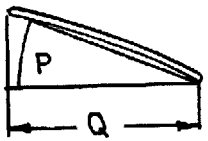
Figure 6H:
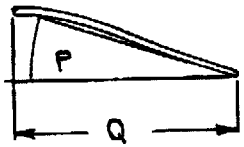
Figure 6G:
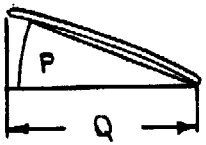
Figure 6L:
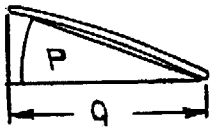
Figure 6K:
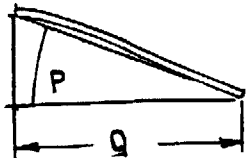
Figure 6J:
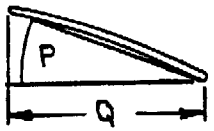

Referring now to FIG. 5, there are shown plural circumferential section lines AA'–LL', sections AA'–DD' being through a first blade (2), and sections EE'–LL' being through a second blade 4.

Referring to FIGS. 6A–6L, the blade cross sections are shown, each having a respective chord length Q and a respective chord angle P, the pitch angle being the angle between the chord of the blade, taken around the circumferential cross section, and a plane perpendicular to the axis of rotation. The chord length Q is the length of the projection of the blade onto the above-mentioned plane perpendicular to the axis of rotation. As mentioned above, FIGS. 6A–6D are sections through the first blade (2) and inspection of those figures shows that the pitch angle decreases with increase of radius along the whole of the first blade (2). The pitch angle decreases with radius throughout the first blade (2).

Turning to FIGS. 6E–6L, inspection of these shows that the chord length Q remains substantially constant over FIGS. 5E–5J, which represent approximately the first 70% of the radial extent of the second blade and falls slightly over the remaining 30% of the blade. The amount of decrease of chord length however amounts to less than 5% of the maximum chord length.

Similarly, the pitch angle falls over the first 70% of the second blade extent, and then remains substantially constant.

The above-discussed blade shapes are exemplary, but other shapes are also envisaged.

Figure 7:
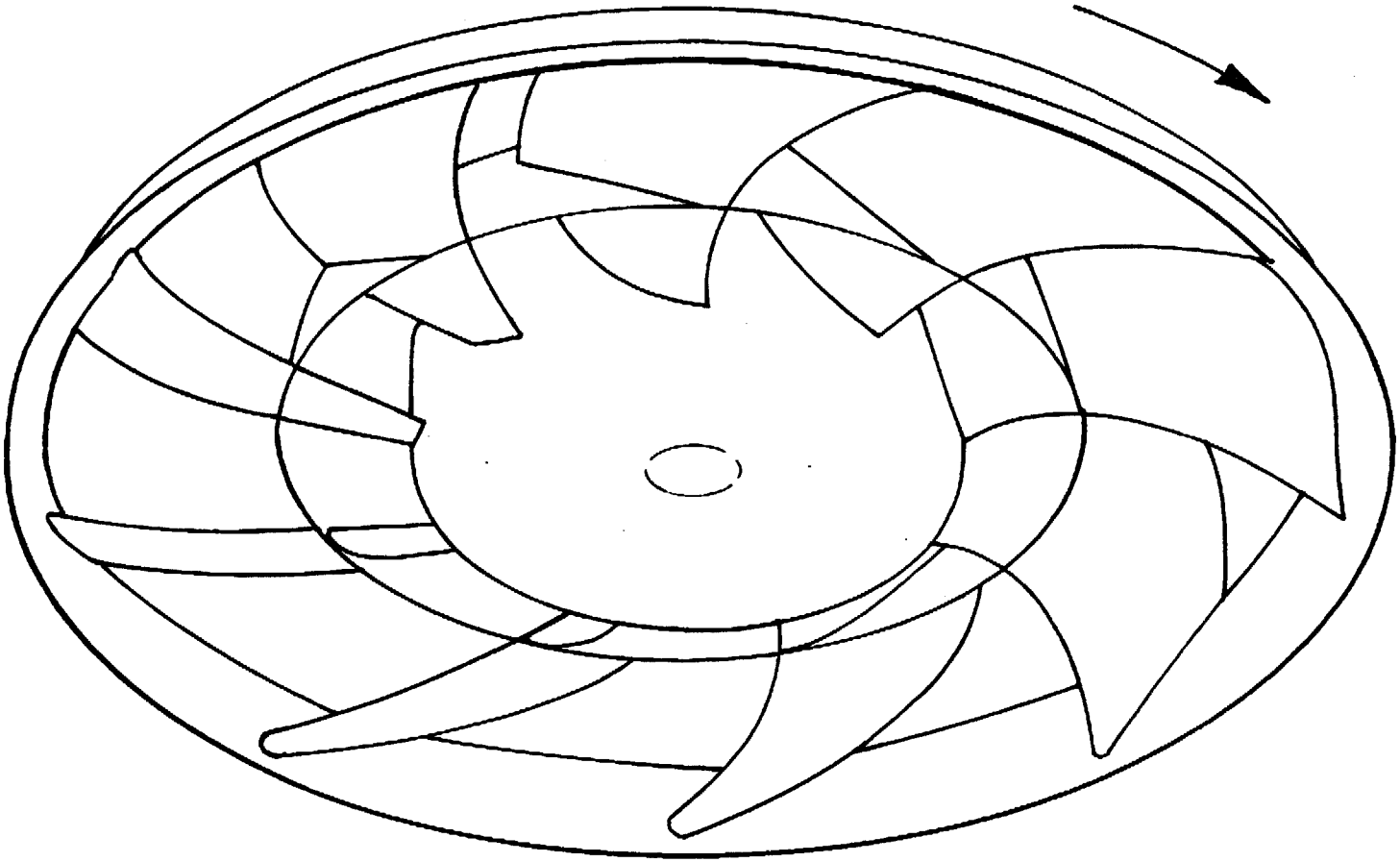
FIG. 7 shows a perspective view of a fan similar to that in FIG. 1, but forwardly-skewed.
Figure 8:
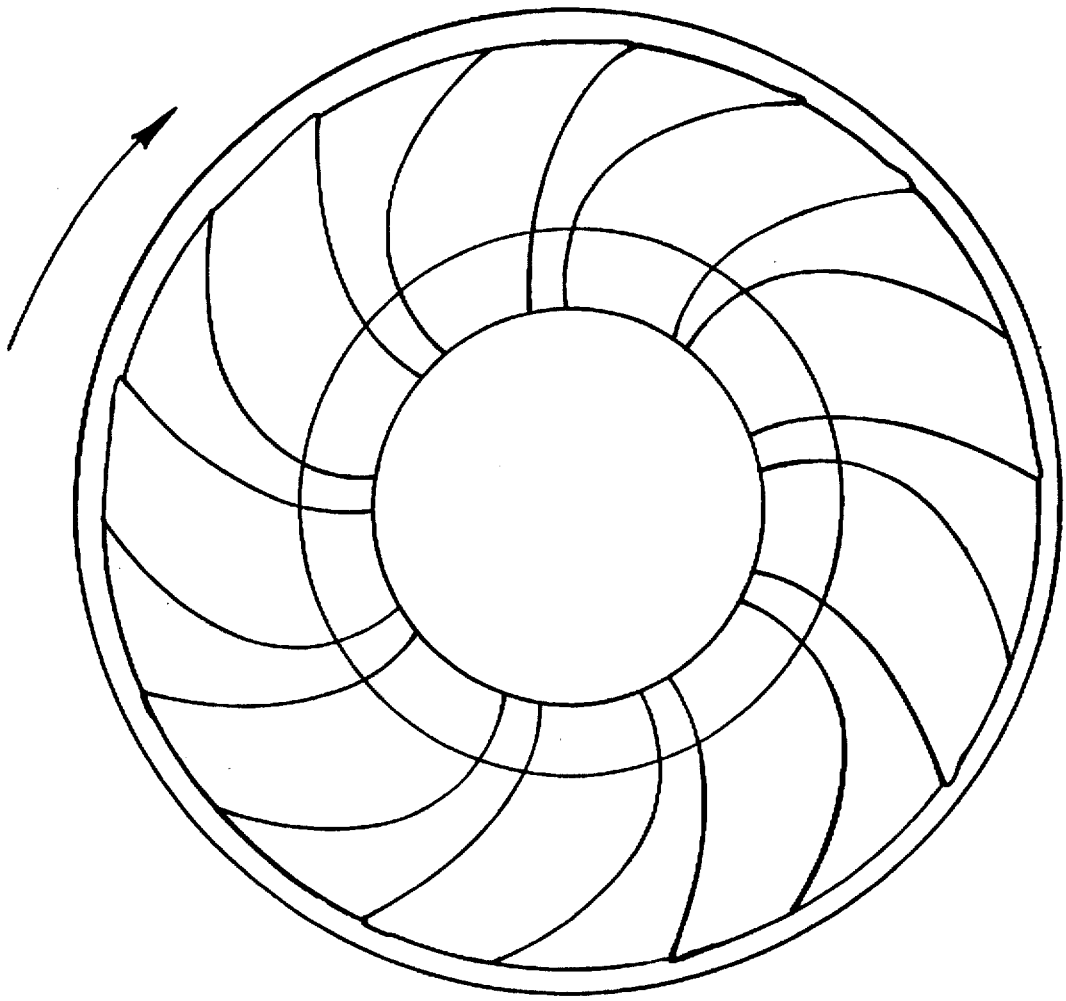
FIG. 8 shows a front projection of the fan of FIG. 7.
Figure 9:
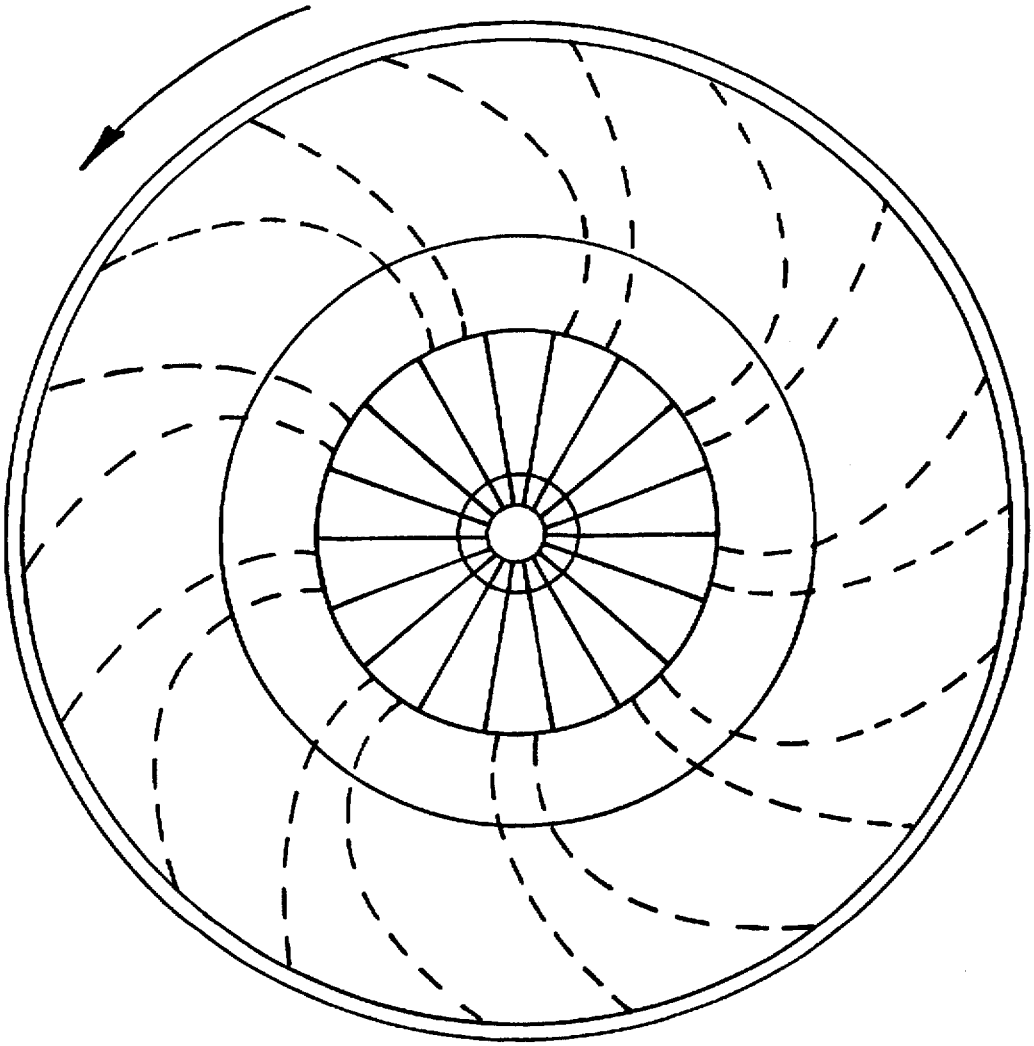
FIG. 9 shows a rear view of the fan of FIG. 7.

The embodiment shown in FIGS. 1–3 has blades which have leading and trailing edges curved in the same sense, reverse with respect to the fan rotation R, with respect to a fan radius. The arrangement is known as dual backward skew. This however is a feature of the embodiment, and other arrangements are possible. Specifically, it is possible for either the inner or outer blades to be disposed radially, to be curved towards the direction of rotation, or to be curved in opposition to the position of rotation. An acoustically advantageous arrangement has the outer second blades (4) with leading and trailing edges curved in the opposite sense to that of the inner radial blades (2). An alternative arrangement shown in FIGS. 7–9 has dual forwardly-skewed blades (2', 4').

It is also possible for a fan to be constructed which has more than two sets of blades. A fan having three blade sets would have a radially inner first plurality of blades extending to a first blade support, a radially intermediate second plurality of blades extending to a second support, and a radially outer third plurality of blades 700 extending from the second support. Four or more sets are also envisaged.

Figure 10:
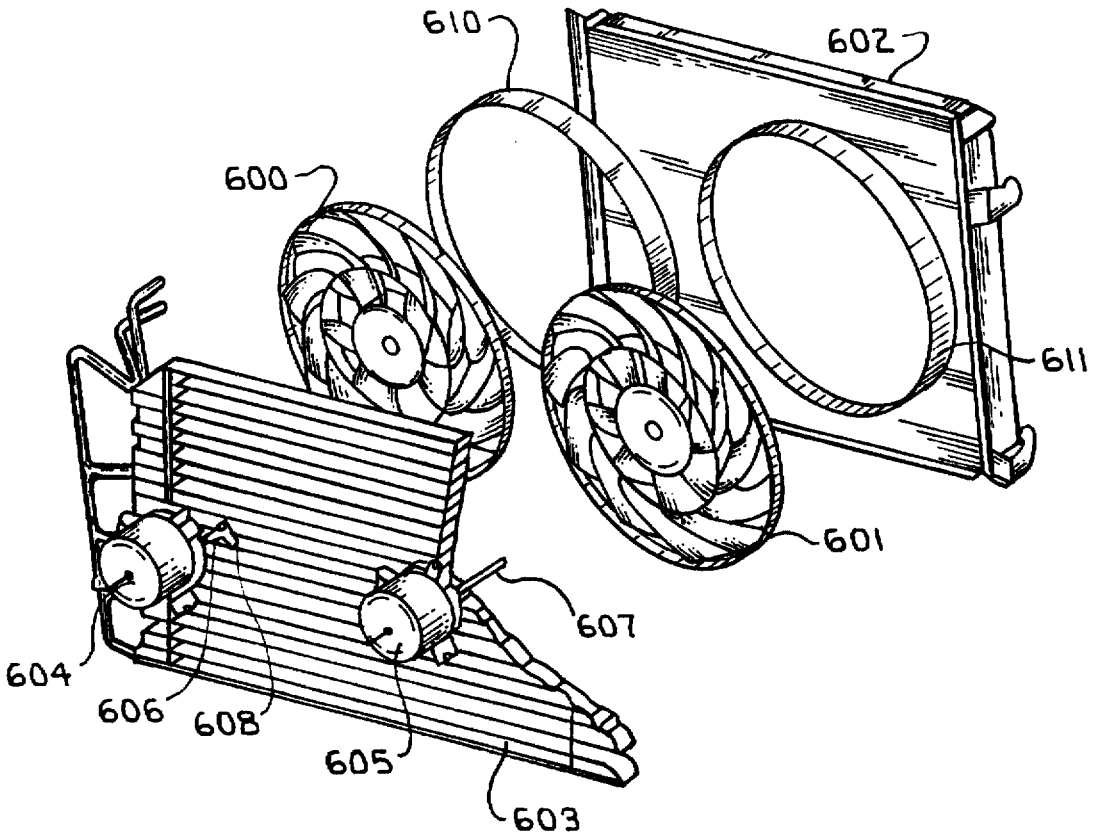
FIG. 10 shows an embodiment of a cooling apparatus in accordance with the invention, using two side-by-side fans.

In FIG. 10, there is shown a cooling apparatus having first and second fans (600,601) disposed side-by-side in substantially the same plane, a radiator (602) on the suction (low-pressure) side of the fans, and a condenser (603) on the high pressure side of the fans. Respective electric motors (604, 605) rotate the fans. The electric motors (604,605) have respective shafts (606,607) which pass through respective holes (608) between the tubes of the condenser (603). The shafts (606,607) project sufficiently from the fan-side of the condenser (603) for the fans (600,601) to be secured thereto. The fans (600,601) are surrounded by respective circular housings (610,611) which are secured to the condenser (603). Alternatively, the housings (610,611) may be secured only to the radiator (602), or both to the condenser (603) and the radiator (602).

It will of course be understood that the cooling apparatus comprising only a single fan sandwiched between two heat exchangers may be provided.

The cooling apparatus described above has the following advantages:

A notable reduction in the noise due to air movement. This is partly due to the fans being enclosed by the housing (610,611), partly due to the absence of support arms which would be necessary to support the fan drive motor within a shroud in a classical cooling arrangement and partly due to the overall rigidity of the assembly being capable of reducing vibration.

Reduction in overall installation size.

Enhanced protection of the fan, for example against snow, or flying stones.

As the fans are shielded all round, there is no risk of entanglement or other accidents to a mechanic working under the bonnet of the vehicle.

In the above description, the fans are described as being mounted between a radiator and a condenser. It will of course be understood that the fan or fans of the invention are not limited to this particular application, and in fact, mounting between any two heat exchangers is possible. Specifically, one of the heat exchangers could be an oil cooler or an air conditioning air cooler. Furthermore, the fan of the invention may be used with a single heat exchanger, and may be driven by any known driving device. For example, a so-called brushless dc motor may be used, or a conventional electric motor; fluid or belt drive arrangements may be employed.

Figure 11:
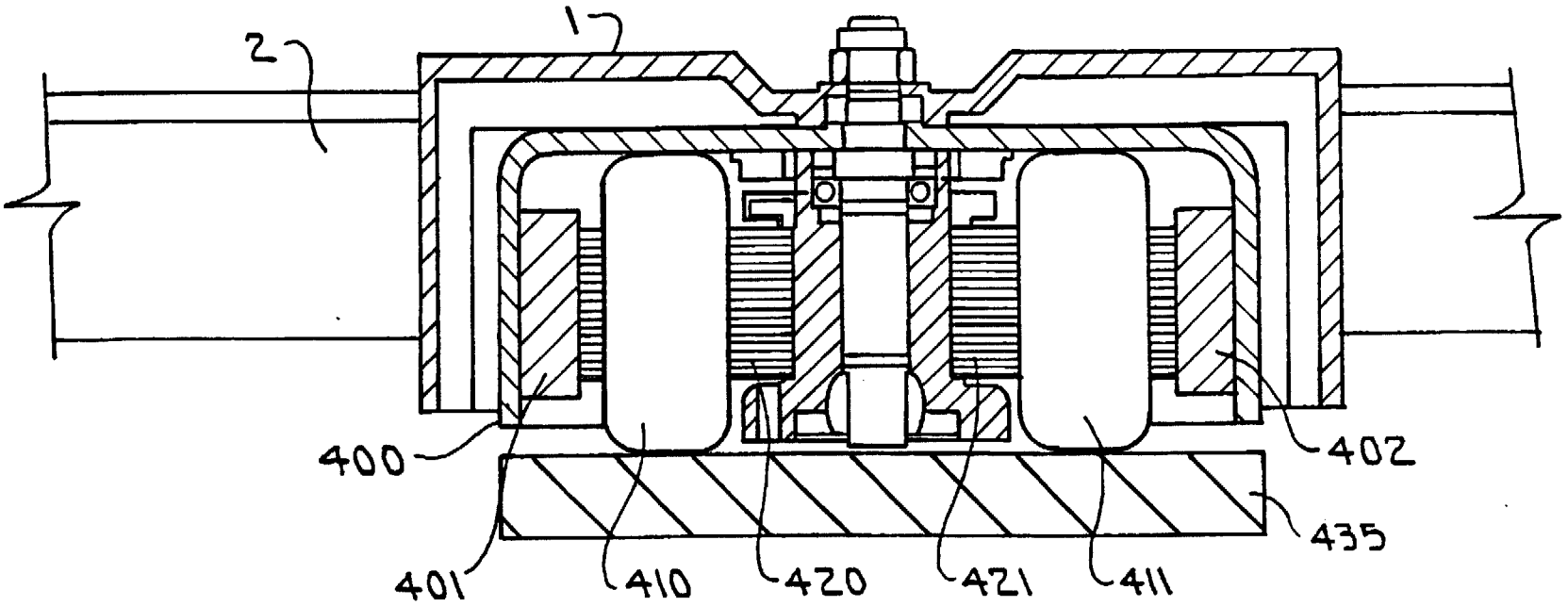
FIG. 11 shows an axial cross-section through a fan of the invention showing an integral electric motor.

In some applications an alternating current supply may be available to power the fan motor. In this case the fan hub may be secured to or form the rotor part of an induction motor, cooperating with a fixed internally-disposed stator. However, where the invention is used in a vehicle application, normally only direct current is available. In this event, the hub may support or be integral with the rotor of a dc motor, and preferably of an electronically-commutated (brushless) dc motor. Such a motor may be embodied as a switched reluctance motor, but, in a more preferred embodiment, the motor is a permanent magnet brushless motor. Referring to FIG. 11, the hub (1) has an internal cup-shaped member (400) which carries permanent magnets (401,402). The cup shaped member (400), which may be integrally formed with the hub (1), or may be secured thereto, forms the rotor of an electronically commutated motor. The motor further consists of a stator which has core members (410,411), each carrying a respective coil (420, 421). The core members (410,411), and hence the coils (420,421) are secured to a base plate (430), which may in turn be secured to a corresponding portion of an associated heat exchanger. The base plate (430) may include the necessary electronic commutating circuitry for switching a direct current supply sequentially to the coils (420,421) to create a rotating magnetic field, thus applying torque to the cup-shaped rotor member (400) for rotating the fan hub (1), and hence the blades (2,3). The rotating field may be controlled depending on the position of the rotor, to ensure synchronism between the stator and rotor fields.

Figure 12:
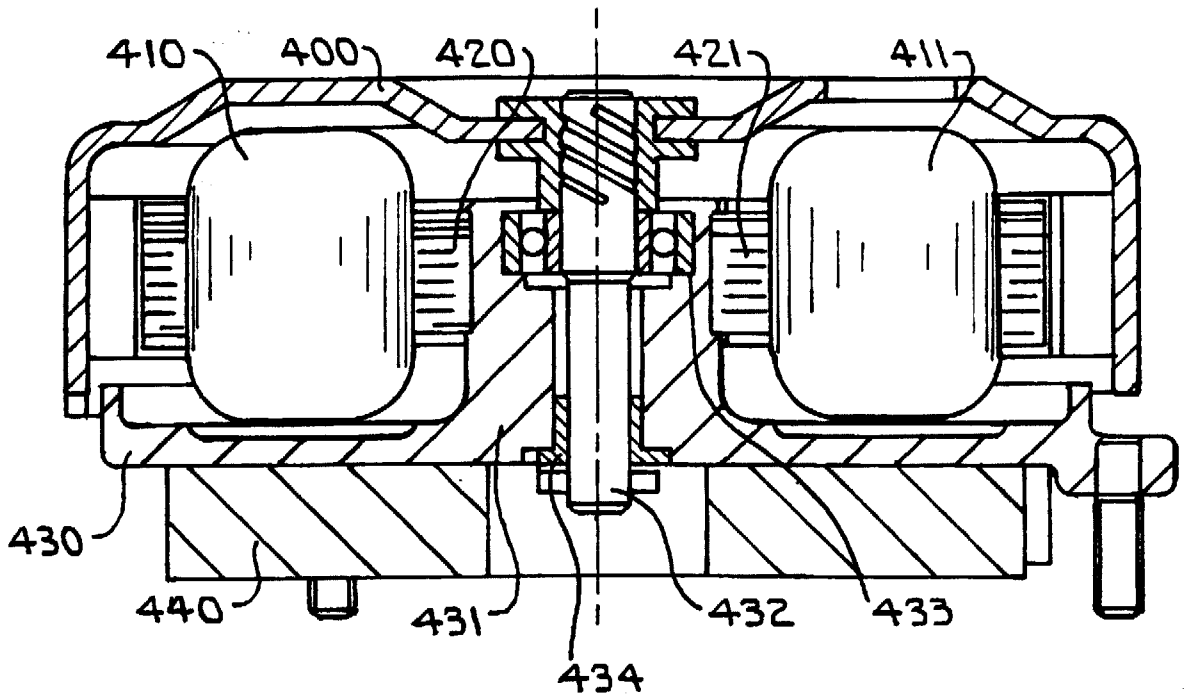
FIG. 12 shows a more detailed view of the construction of the motor of FIG. 10.

FIG. 12 shows a more detailed construction of the rotor and stator described above. Referring to FIG. 12, it will be seen that the base plate member (430) has a central boss portion (431) which extends axially of the associated fan, and which supports a shaft member (432) via first and second bearings (433,434). The first bearing (433) is a ball bearing and the second bearing (434) is a sleeve bearing. In the presently described device the base plate member (430) supports a circuit module (440). Thus, it will be seen that, where the fan and base plate are mounted to a face portion of a heat exchanger, the circuit module (440) will be on the same side of the heat exchanger as the fan.

Figure 13:
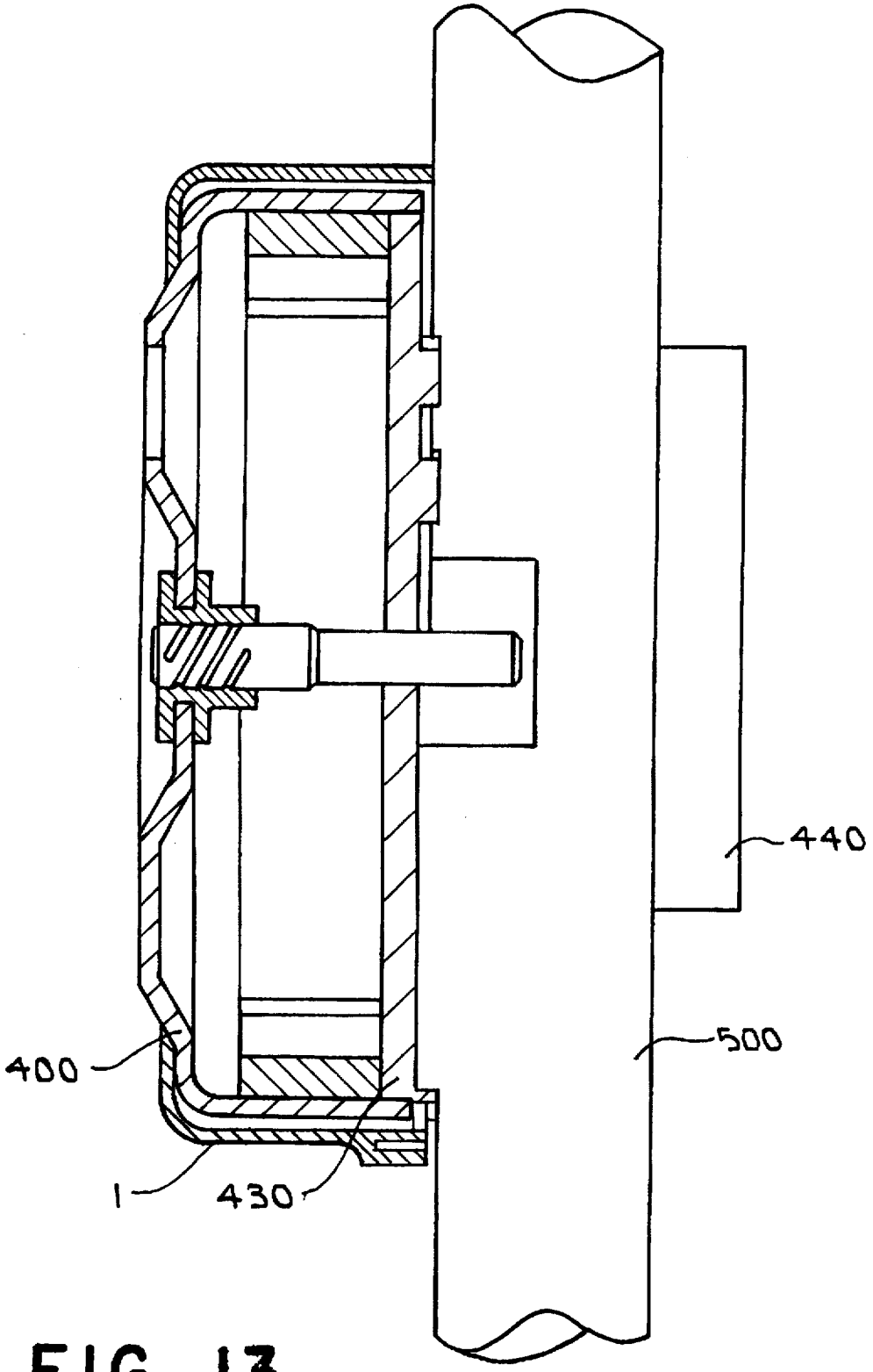
FIG. 13 shows a motor having remote commutating circuitry.
Figure 14:
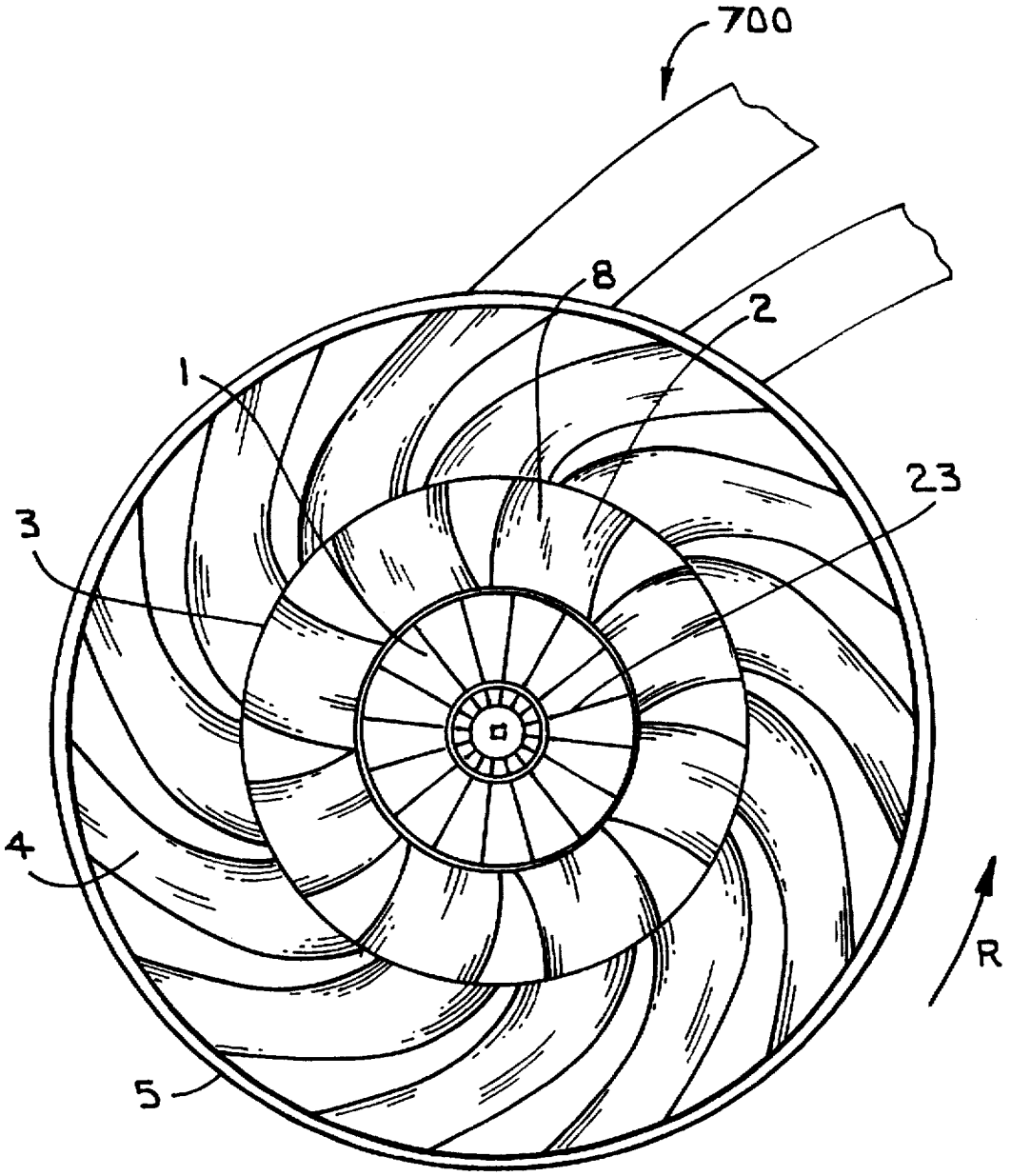
FIG. 14 shows a projection of a fan in accordance with another embodiment of the invention in which there is a third plurality of blades.

An alternative arrangement is shown in FIG. 13. Referring to FIG. 13 a heat exchanger (500) supports the base plate (430) on one surface thereof, and on the opposing surface there is disposed the circuit module (440). This arrangement is advantageous in a vehicle application where the heat exchanger (500) is a vehicle radiator, and where the circuit module (440) is better cooled by being disposed on the side of the radiator directed towards an incoming airflow. It will of course be realised that the circuit module could instead be located at a position remote from the radiator, for example secured to the vehicle body work itself. However, this involves complications when mounting the arrangement, since wires must necessarily connect the stator and the circuit module.

Where the fan is used with a single heat exchanger, it may be embodied as a so-called "pusher" fan, blowing air through the heat exchanger, or a so-called "puller" fan, drawing air through the heat exchanger. In cases where high cooling needs occur, a dual in-line fan system may be provided, having a "pusher" fan on one side of the heat exchanger and a "puller" fan on the other side.

The invention claimed is:

1. A fan having an axial direction of flow comprising a hub portion having secured thereto a first plurality of first blades extending therefrom radially outwardly to a first circumferentially-extending blade support member, a second plurality of second blades extending radially outwardly from the first support member, and each second blade in the second blade plurality establishes a pitch angle relative to the axial direction of flow in which the pitch angle decreases along a portion of the radial extent from the first blade support member and outwardly thereof for each of the second blades in the second blade plurality, the second blade pitch angles remaining substantially constant thereafter.

2. An axial flow fan as claimed in claim 1 wherein said first plurality is different in number to said second plurality.

3. An axial flow fan as claimed in claim 1 wherein said second plurality is a prime number.

4. An axial flow fan as claimed in claim 3 wherein the first plurality of first blades is a prime number of said blades.

5. An axial flow fan as claimed in claim 1 wherein, at the first blade support member, only one of the first blades in the plurality of first blades coincides circumferentially with only one of the second blades in the plurality of second blades.

6. An axial flow fan as claimed in claim 1 wherein each first blade in the first blade plurality establishes a pitch angle relative to the axial direction of flow in which the pitch angle decreases along the radial extent of each of the first blades in the first blade plurality.

7. An axial flow fan as claimed in claim 1 wherein each of the first blades in the first plurality of first blades have chord lengths in which each respective first blade chord length increases along the radial extent thereof.

8. An axial flow fan as claimed in claim 1 wherein each of the second blades in the second plurality of second blades have chord lengths in which each respective second blade chord length remains substantially constant over a radial portion thereof and the chord length thereafter decreasing over the remaining radial portion thereof.

9. An axial flow fan as claimed in claim 1 wherein each of the blades in the second plurality of second blades have chord lengths in which each respective second blade chord length remains substantially constant along the radial extent thereof.

10. An axial flow fan as claimed in claim 1 wherein the hub portion has an axial extent, the axial extent of the hub portion being greater than the axial extent of the first blade support member.

11. A fan having an axial direction of flow comprising a hub portion having secured thereto a first plurality of first blades extending therefrom radially outwardly to a first circumferentially-extending blade support member, and a second plurality of second blades extending radially outwardly from the first support member wherein the second plurality of second blades extend to a second circumferentially-extending blade support member, and each second blade in said second blade plurality establishes a pitch angle relative to the axial direction of flow in which the pitch angle decreases along a portion of the radial extent from the first blade support member and outwardly thereof for each of the second blades in the second blade plurality, the second blade pitch angles remaining substantially constant thereafter.

12. An axial flow fan as claimed in claim 11 wherein said first plurality of first blades is different in number to said second plurality of second blades.

13. An axial flow fan as claimed in claim 12 wherein said second plurality of second blades is a prime number of blades.

14. An axial flow fan as claimed in claim 13 wherein the first plurality of first blades is a prime number of blades.

15. An axial flow fan as claimed in claim 11 wherein, at the first blade support member, only one of the first blades in the first plurality of first blades coincides circumferentially with only a second blade in the second plurality of second blades.

16. An axial flow fan as claimed in claim 11 wherein each first blade in the first blade plurality establishes a pitch angle relative to the axial direction of flow in which the pitch angle decreases along the radial extent of each of the first blades in the first blade plurality.

17. An axial flow fan as claimed in claim 11 wherein each of the first blades in the first plurality of first blades have chord lengths in which each respective first blade chord length increases along the radial extent thereof.

18. An axial flow fan as claimed in claim 11 wherein each of the second blades in the second plurality of second blades have chord lengths in which each respective second blade chord length remains substantially constant over a first radial portion thereof and the chord length thereafter decreasing over the remaining radial portion thereof.

19. An axial flow fan as claimed in claim 11 wherein each of the second blades in the second plurality of second blades have chord lengths in which each respective second blade chord length remains substantially constant along the radial extent thereof.

20. An axial flow fan as claimed in claim 11 wherein the hub portion has an axial extent, the axial extent of the hub portion being greater than the axial extent of the first blade support member.

21. An axial flow fan as claimed in claim 11 wherein the second blade tip support member has a smaller axial extent that the first blade tip support member.

22. An axial flow fan as claimed in claim 11 wherein a third plurality of blades extends radially outwardly from the second blade support member.

* * * * *